US007479073B2

(12) United States Patent
Pelley et al.

(10) Patent No.: US 7,479,073 B2
(45) Date of Patent: Jan. 20, 2009

(54) SIMULATED GOLF GAME

(76) Inventors: Woodrow Lloyd Pelley, 145 Westchester Road, Oakville, Ontario (CA) L6H 6H9; Jeffery Victor Hadfield, 1240 Westview Terrace, Unit 11, Oakville, Ontario (CA) L6M 3M4

( * ) Notice: Subject to any disclaimer, the term of this patent is extended or adjusted under 35 U.S.C. 154(b) by 26 days.

(21) Appl. No.: 11/741,143

(22) Filed: Apr. 27, 2007

(65) Prior Publication Data

US 2008/0268986 A1 Oct. 30, 2008

(51) Int. Cl.
*A63B 67/02* (2006.01)

(52) U.S. Cl. ..... 473/409; 473/168

(58) Field of Classification Search ..... 473/167–170, 473/407, 409; 434/252; 283/49, 50
See application file for complete search history.

(56) References Cited

U.S. PATENT DOCUMENTS 1,851,423 A 3/1932 Ely
1,869,642 A 8/1932 Woolman
2,003,074 A 5/1935 Gage
2,455,806 A 12/1948 Reach
2,482,210 A 9/1949 Reach, Sr., et al.
2,490,961 A 12/1949 Hendry
2,577,690 A 12/1951 Reach
3,083,021 A 3/1963 Reilly
3,129,943 A 4/1964 McKee
3,464,703 A 9/1969 Vallas
3,552,290 A * 1/1971 Brechtel ..... 396/661
3,599,980 A 8/1971 Harmond
3,685,832 A 8/1972 Johnson
3,708,173 A 1/1973 Hewson, Jr.
3,820,786 A * 6/1974 Candor ..... 473/409
3,904,209 A 9/1975 Thomas
3,937,466 A * 2/1976 Candor ..... 473/409
3,949,987 A * 4/1976 Candor ..... 473/407
3,990,708 A 11/1976 Ingwersen
4,063,738 A 12/1977 Michalson
4,129,300 A 12/1978 Magnuson
4,145,053 A * 3/1979 Healey ..... 473/169
4,192,510 A 3/1980 Miller
4,283,056 A 8/1981 Miller
4,331,425 A * 5/1982 Davis, Jr. ..... 434/252
4,505,478 A * 3/1985 Riethmiller ..... 473/407

(Continued)

*Primary Examiner*—Mark S Graham
(74) *Attorney, Agent, or Firm*—Gowan Intellectual Property

(57) ABSTRACT

A golf type game for playing at a driving range, or other golf practice facility is provided consisting of a series of cards that simulate a series of golf holes. The cards are placed and moved within a handbook that has an opaque cover with a slot so that the player can determine his own position and make his own strategy decisions to determine his desired target and/or target line. Once closed, the handbook cover has grid markings that correspond to grid markings on the driving range so that a shot outcome can be transferred to said card. The player then plays a shot directly towards a target, and observes the shot outcome. A series of holes are provided on said cover through which the player can mark the shot outcome on the card, prior to opening the handbook. By being opaque, however, the player marks the card in an unbiased fashion. As a result of using the player's own strategy, moving the card to provide a consistent driving range target, and having an unbiased marking of the shot outcome on the card, a more realistic simulation of a golf game results.

16 Claims, 6 Drawing Sheets

U.S. PATENT DOCUMENTS 4,572,512 A 2/1986 Tegart
4,655,451 A * 4/1987 Townsley ..... 473/407
4,666,157 A * 5/1987 Bodine et al. ..... 473/407
4,696,474 A 9/1987 Tegart
4,743,026 A * 5/1988 Eady ..... 473/162
4,783,071 A * 11/1988 Tattershall ..... 473/407
4,798,385 A 1/1989 Tegart
4,928,973 A 5/1990 Perry et al.
5,094,451 A * 3/1992 Glamack ..... 473/407
5,163,683 A 11/1992 Oswald
5,265,875 A 11/1993 Fitzgerald
5,284,340 A * 2/1994 Laakso ..... 473/407
5,431,402 A * 7/1995 Aguilera ..... 473/169
5,490,671 A * 2/1996 Picard ..... 473/168
5,564,988 A * 10/1996 Brooks ..... 473/150
5,588,652 A 12/1996 Lang
5,636,872 A * 6/1997 Gamer et al. ..... 283/49
5,655,974 A 8/1997 Bair
6,027,417 A * 2/2000 Zoretic et al. ..... 473/407
6,336,875 B1 * 1/2002 Rice ..... 473/407
6,409,607 B1 6/2002 Libit et al.
7,137,901 B2 11/2006 McNamara, III
2003/0119594 A1 * 6/2003 Hopkins ..... 473/150
2005/0046109 A1 * 3/2005 Lewis ..... 273/245
2007/0078031 A1 * 4/2007 Mannies et al. ..... 473/407

* cited by examiner

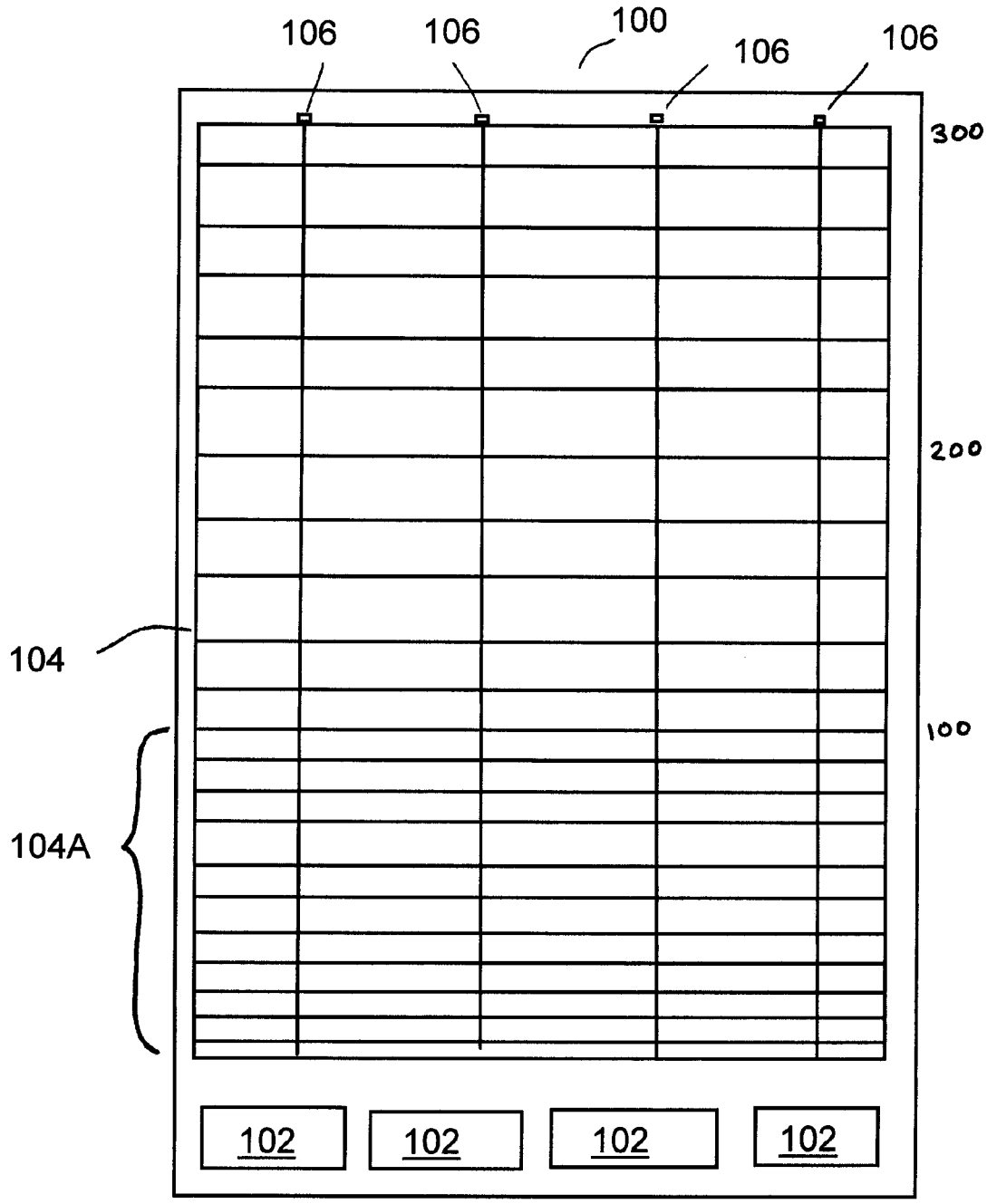
Fig. 4
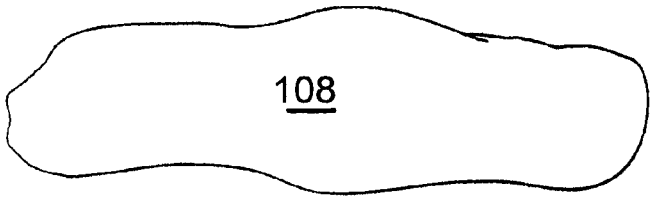

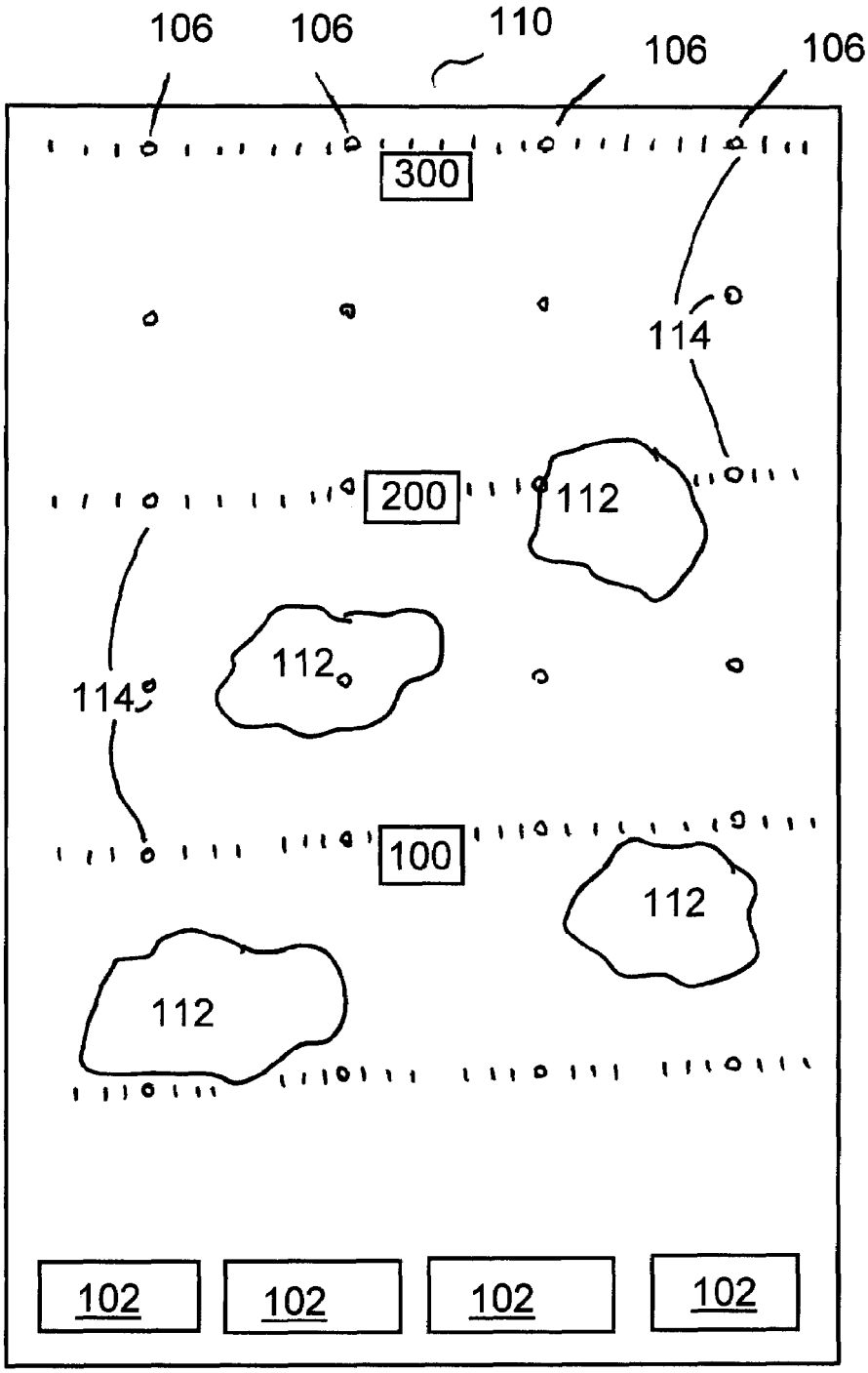
Fig. 5
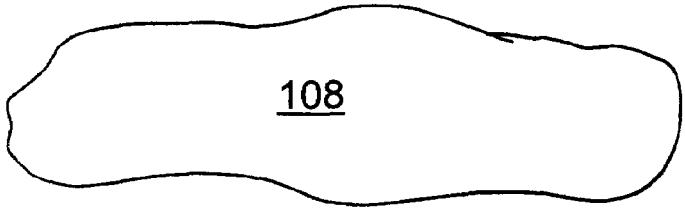

SIMULATED GOLF GAME

FIELD OF THE INVENTION

The present invention relates to the field of golf, and in particular, relates to a simulated golf game that can be played over a smaller area, such as that found at a golf practice area or driving range.

BACKGROUND OF THE INVENTION

Two main complaints that are currently prevalent in the golf industry are that the cost of the game has increased to a point where it is no longer an inexpensive recreational activity, and that the game takes too long to play since rounds of golf can often take up to 6 hours or more to play. A related complaint is that because of recent advances in technology, longer and longer courses are required, which require greater areas of land. This exacerbates the high cost complaint, and by necessity, increases the time to play the game.

Moreover, it is also known by the average golfer that to improve at the game, it is necessary to practice, and numerous driving ranges, or more generally, golf practice facilities, are available to golfers in order to practice the golf swing. However, commonly the player finds that hitting balls at a driving range can be boring, and the practice session may not be beneficial to the player if he is ingraining incorrect swing patterns or swing mechanics. As such, many players do not use these practise facilities to their optimum advantage.

A further disadvantage of most golf training facilities, and driving ranges, is that the golfer is merely practising the golf swing, and is not receiving instruction on the strategies for playing the game. For example, while a player may be able to practice hitting a driver at a driving range, he is not taught when it would be beneficial to use some other club on the course when playing the game. The player must sort this out for themselves while actually playing the game.

Golf teaching professionals are commonly available at a driving range, but they are typically restricted to only teaching the golf swing. There is little or no opportunity to discuss strategy with the player in a specific, real game situation.

Numerous patents have previously been issued to inventors attempting to resolve or ameliorate some or all of these problems. Typically, they provide or involve a method to simulate a golf game while at a practice facility.

For example, U.S. Pat. No. 3,990,708 discloses a golf course wherein all drives are hit on a driving range which is provided with yardage distance markers. The player registers his estimated distance on a display board and, depending on the length of the alleged hole, the display board tells the player to either "hit again", "register yardage" or "pitch to pitching green". The player then proceeds to hit the second shot for the theoretical hole, which can be either a par 4 or a par 5, and continues hitting from the driving tee until he receives the designation "hit to designated mechanized range green".

The mechanized range green is divided into segments or areas, each representative of a given distance from a flag stick. The areas are defined by a wire mesh material which is supported above the ground surface and intercepts the ball. The ball proceeds over a sloped portion of the mesh to a ball return conduit wherein it actuates a contact switch which indicates to the player which segment the ball is hit onto. The player then goes to an actual putting green and places his ball at the distance indicated by the approach shot which was caught by a segment of the mesh. A minimum of walking is involved, hence expediting the play. The problem with this arrangement is the monotony involved in hitting one, two or three balls from the same driving tee before hitting the ball to land on the mechanized putting green. The entire game of hitting fairway woods or long approach shots from a varying slope terrain is eliminated, and the only true golf shots are the initial drive and the putting on the actual putting green.

A number of patents relating to golf practice areas have been developed which provide the practicing golfer with an indication of the length of his drive by trapping the ball by a net, or a transversely inclined, hard landing area which directs it into a return trough or gutter for actuation of a distance indicator and redelivery to the practice tee. See, for example, U.S. Pat. No. 1,869,642.

In this patent, all drives, regardless of direction, end up in a gutter at the side of the fairway. Hence a ball hit to the right or left of center can register the same yardage as a ball hit down the middle. Only one playable fairway and green are provided, creating monotony rather than the challenge of eighteen different holes.

Also know are the so-called computerized golf wherein a picture of a famous golf hole appears in front of the player and he hits the drive which is captured by a net or similar target and the distance and direction of the drive is indicated by a computer. The picture then changes to the remainder of the hole so that the player may hit a second shot (or a third shot on a par 5 hole) toward the pictured green. This apparatus is most commonly utilized indoors and provides very little exercise other than the swinging of the club.

Driving ranges with a plurality of greens located at differing distances and directions have also been proposed. See for example, U.S. Pat. No. 3,599,980.

U.S. Pat. No. 3,708,173 discloses a plurality of driving ranges with each green having 18 flags located thereon. Thus, an entire game of par 3 golf may be played from a single tee by directing the shots at the flag bearing the number of the hole being played. Actual putting of the ball is not involved.

The concept of combining a single target green with a plurality of driving tees located at varying distances and varying angles with respect to the target tee is disclosed in U.S. Pat. No. 4,063,738. In this arrangement, the second shot is not played from its normal location but from an arbitrary fairway hitting position which represents the remaining yardage for the hole. Thus, deviations in the line of flight of the originally hit ball are not taken into account. The position of the balls on the target green are indicated by three concentric circles surrounding the pin on the target green. All putting strokes are performed at a putting green which is located behind the driving tees and has a separate pin for each hole. The game is played in sequence of first hitting all drives, then hitting all fairway shots, and the approach shots from the tee area, and then moving to the actual putting greens to complete the putting for each hole. Obviously, this procedure bears little resemblance to the normal game of golf, and has not been successful in attracting more players.

In U.S. Pat. No. 5,265,875, a reduced area golf course is provided, which can be played at night. The course utilizes a common driving range environment for tee shots for all par 4's and 5's, and provides an adjacent golf course in which the initial 100 to 150 yards for these holes has been removed. The golfer is provided which an indication where his drive on the driving range landed, and then translates that information on the actual course. Again, the golfer is required to hit several, or all drives in succession, and therefore, the procedure does not properly simulate the normal game of golf.

In general though, none of the cited prior art documents provide a realistic simulated golf game in which the player plays the course in order while being located at one position at a driving range or other golf practice facility. Further, none of the cited prior art provides a realistic golf game simulation that can be played in a localized environment that provides a convenient method for a golf professional to provide lessons on golf course "management", or input on the strategy of playing the game.

SUMMARY OF THE INVENTION

Accordingly, it is a principal advantage of the present invention to provide a realistic golf game simulation that can be played at a driving range, or some other golf practice facility.

It is a further advantage of the present invention to provide a golf game simulation that can be played from a localized area, and which is adapted for teaching applications.

The advantages set out hereinabove, as well as other objects and goals inherent thereto, are at least partially or fully provided by the simulated golf game, and teaching technique, of the present invention, as set out herein below.

Accordingly, in one aspect, the present invention provides a simulated golf game comprising a driving range area which is divided into a grid system, and providing at least one target. A handbook is provided having a plurality of cards providing pictorial representations of actual or virtual golf holes. Preferably cards for 18 golf holes are provided, and the cards are used one at a time, preferably in a pre-established order.

The handbook is provided with a preferably largely opaque cover. The cover has a target reference indicator, and a grid system which correlates to the grid system found on the driving range area. The target reference indicator is preferably a slot or transparent area on the cover, which allows the golfer to move the golf hole pictorial card so that the golfers present position can be established, and the golfer's desired target can also be established. The cover grid system is also preferably established by a series of holes through the cover at preselected points on the grid system, which holes allow the golfer to mark or otherwise identify positions on the card.

Optionally, the driving range area can include simulated or actual target greens, and a variety of grid systems which will allow various players from different driving areas "bays" to simultaneously used the driving range area.

A putting green, which preferably also act as a chipping green, is also preferably located adjacent to, and services a plurality of driving area bays.

The method of playing the game will be discussed in detail hereinbelow, with reference to the drawings, but in general, the golfer reviews the card to determine his current location on the simulated golf hole. He then selects his target line and distance based on his strategic review of the golf hole being played. The desired distance can be read from distance indicators on the card and/or the cover, so that the golfer can select his desired line and the desired distance.

The card is then placed within the handbook so that the players current position is located within a preselected area on the handbook cover, and the golfer's target, and/or target line, is located on the target reference indicator.

The cover is preferably closed and opaque so the golfer is only aware of his current position and his target or target line. The golfer then establishes his target on the driving range area, whether it be a preselected marker such as a pole, signboard, tree, simulated green, or the like, and takes his shot. The golfer watches the ball, or by using some other automated system, determines where on the grid the ball has landed, or finished. The player then, in an unbiased manner places a mark through the grid system on the cover, in order to provide a mark on the hole card, without knowing exactly where the shot landed on the card. The player then opens the handbook in order to view the mark made on the card, and this mark determines where his next shot is to be played (e.g. fairway, short rough, long rough sand, pine chips, etc. or in a hazard). The outcome of the player's shot is solely decided by the outcome on the grid, and thus, the player cannot modify the outcome to avoid hazards or more difficult shots. As such, an unbiased evaluation of the outcome of the player's shot is provided.

For example, if the mark made on the card is in a sand trap or an area of rough, the player would make his next shot from those specialized surfaces, which are provided in each bay, or nearby in a centralized area. The golfer would then repeat the same process as before, namely reviewing the card in order to establish his next shot by using an appropriate strategy. Then, once the target is selected, the golfer inserts the card into the handbook with his current position is within the preselected area, and the target and/or target line located on the target reference indicator. The golfer takes his next shot from the appropriate area, observes the result, and then marks the outcome on the card using the grid system on the handbook cover.

The process is repeated until the golfer reaches the vicinity of the green and then the grid system will preferably identify a location on or near an adjacent putting and/or chipping green or area, in order for the golfer to locate his golf ball. The player then chips and/or putts out in a normal fashion.

The player then returns to his allotted driving range bay, and repeats the process using the next card in the handbook until all cards have been used. In this manner, the present invention provides a game wherein at least the longer shots, and preferably all of those shots which are typically played on a golf course, are played on the driving range or golf practice facility, in the order they would normally be played on a golf course.

A key feature of the present invention is that the player is able to use the cards in order to determine his own desired target, and then, in an unbiased fashion, determine the outcome of the shot made. This is possible since the handbook cover grid system requires the golfer to indicate on the card, the exact location of the shot outcome without knowing where that location is on the card until the handbook cover is raised. Thus, the present invention, in its preferred embodiment requires the use of a card system with a grid that relates to a grid system provided on the range, and which enables the player to determine without bias, where each shot has landed.

Further, the golf game card system provides the player with the ability to independently establish their desired targets for each shot, and thus more closely emulates the strategy involved in playing a regular golf game. As such, the present invention provides a simulated golf game in which the player utilizes strategy to determine the optimal shot to be played, plays that shot from a centralized area to a selected target, evaluates the outcome of the shot in an unbiased manner, and, when appropriate, chips and putts to or on an adjacent putting and/or chipping green.

As such, the player is able to closely simulate an actual golf game within a localized area at a golf practice or driving range facility.

Further, since the simulated golf game is played within the confines of a driving range facility, a teaching professional is readily available to review strategy and course management techniques with the player, and thus, train the player on actually playing the game of golf, rather than just assisting in developing a golf swing.

As such, in a further aspect, the present invention also provides a method of teaching the strategy of the game of golf comprising: providing a teaching professional to a player who is playing the game described hereinabove; and having the teaching professional review the strategy decisions made by the player. The teaching professional can also evaluate and comment on the golf swing techniques, and the like, as needed or desired. Of most importance, though, is that the golf professional is able to review the player's strategy decisions being made on a simulated course, within a relatively short time frame. As such, the teaching professional can move from bay to bay to assist a number of players, or can remain in one bay to assist a player throughout a simulated round of golf.

In a still further aspect, the present invention also provides a handbook and card system for use in a simulated golf game, as described herein. The handbook and card are preferably actual devices and products that can be provided to the player, but alternatively, the functions of the handbook and the card can be simulated using a computerized system such as a computer, a PDA, or the like.

BRIEF DESCRIPTION OF THE DRAWINGS

Embodiments of this invention will now be described by way of example only in association with the accompanying drawings in which:

FIG. 4 is an overhead plan view of one embodiment of a driving range which can be used in practice of the present invention;

FIG. 5 is an overhead view of a second embodiment of a driving range of use in the present invention;

DETAILED DESCRIPTION OF THE PREFERRED EMBODIMENTS

Figure 1:
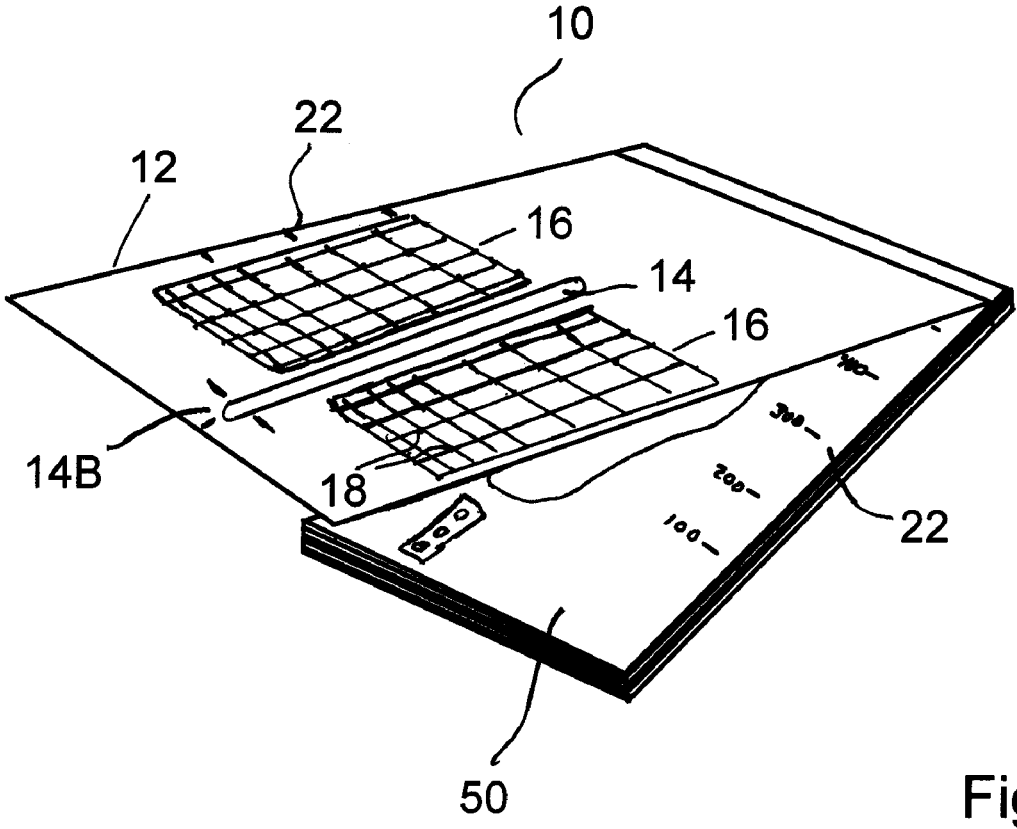
FIG. 1 is a perspective view of a card and handbook of the present invention.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, a preferred handbook 10 is shown in an open position wherein a first golf hole card 50 is visible. While any suitable arrangement of cards, handbooks and covers can be used, in FIG. 1, a preferred embodiment is shown wherein a "notepad" construction is shown comprising a cardboard cover 12, eighteen cards 50 printed on paper and representing 18 holes, with a bottom cover (not shown) made of cardboard, all glued or otherwise held together at one end.

It will be clear to the skilled artisan that any suitable material for handbook 10 might be used, including paper, cardboard, plastic and the like. Further, while 18 holes represents a standard round of golf, the number of cards 50 in notebook 10 can be changed to any suitable value, such as 9, 18, 27 or 36 cards, or any other suitable number whether or not related to the standard golf game.

In use, after a player is finished playing a hole, top card 50 is removed from handbook 10, and a fresh card 50 will be revealed. This process is repeated until the simulated game is completed.

Figure 2:
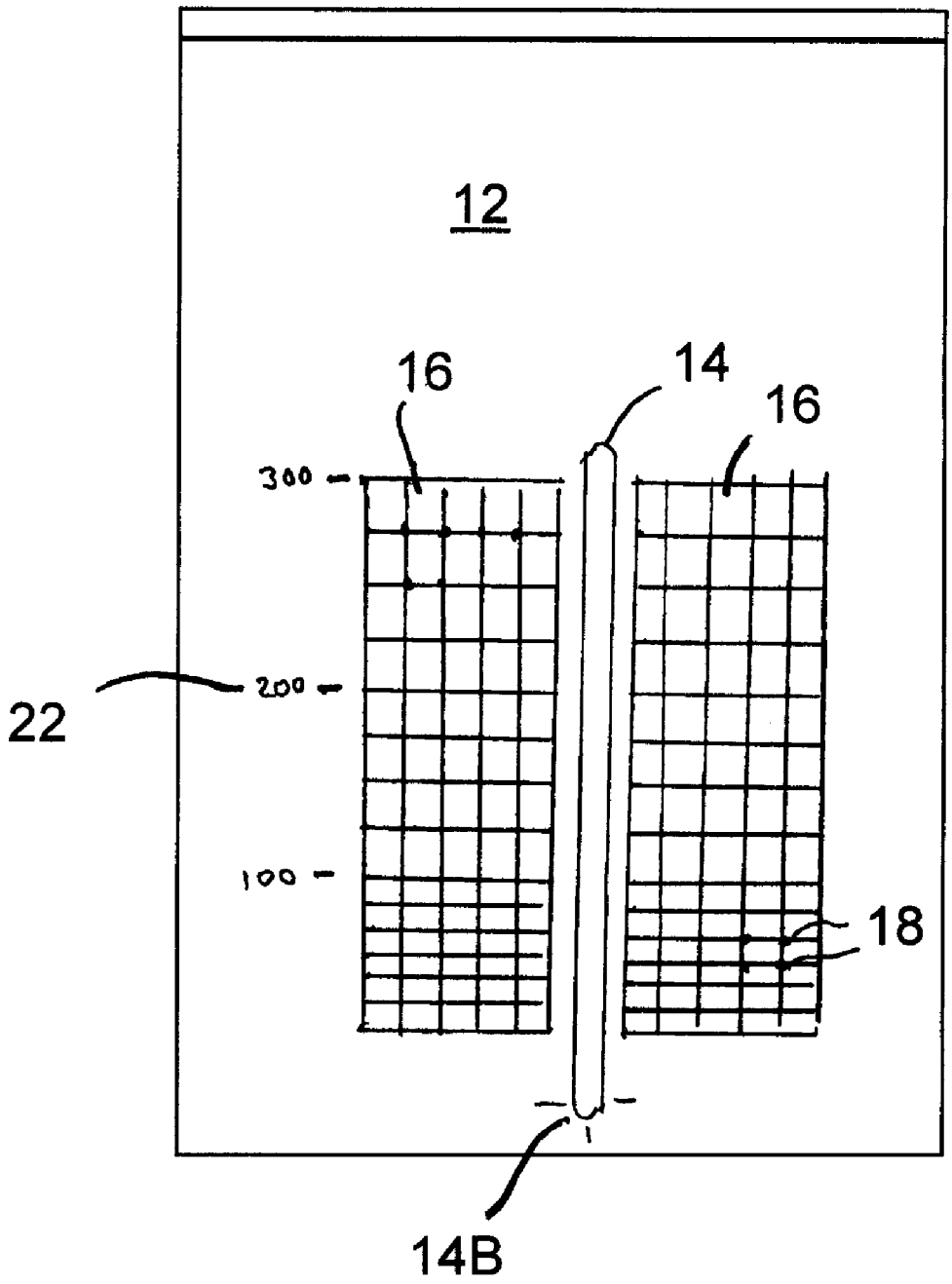
FIG. 2 is view of a handbook cover to be used in the practice of the present invention.

In FIG. 2, details of the cover 12 of handbook 10 is shown having a slot 14. In use, the player will tear card 50 from handbook 10 so that card 50 can be positioned under cover 12 such that the player's current position is located at the base 14B of slot 14. The player's selected target and/or target line is then positioned so that it is also visible within slot 14.

A grid 16 is provided on cover 12, and the grid size and spacing is such that the card grid correlates to the grid provided on the driving range, as discussed hereinbelow. At the intersections of the grid pattern, holes 18 are provided through which a pen or other marker can be inserted in order to mark the card at the appropriate grid location.

Grid 16 can be of a constant size across cover 12, but preferably, the grid lines are closer together in the area nearest to the golfer's current position. With this more detailed grid, the location of the golfer's shot can be more accurately identified on shorter shots. The gird on the driving range would also be modified in a similar fashion.

Grid 16 can be printed on cover 12, or can be merely established by holes 18 which are punched through cover 12 in a grid shaped pattern.

Yardage indicators 22 can also be preferably provided on the cards 50, and/or cover 12 to assist the player in determining the desired length of a shot.

The pictorial representation of the golf hole on card 50, the cover grid 16, and the driving range grid will all be scaled so as to correlate to one another. For example, the cover grid 16 can be provided so as to cover a distance of up to 300 yards, or more, which will be acceptable for all but the longest of players. The driving range grid, as shown in FIG. 4, will preferably also have a distance of up to 300 yards, or more, in order to relate to the cover grid. Of course, these distance can vary depending on the room available at the driving range facility and/or the operator's desired arrangements.

Figure 3:
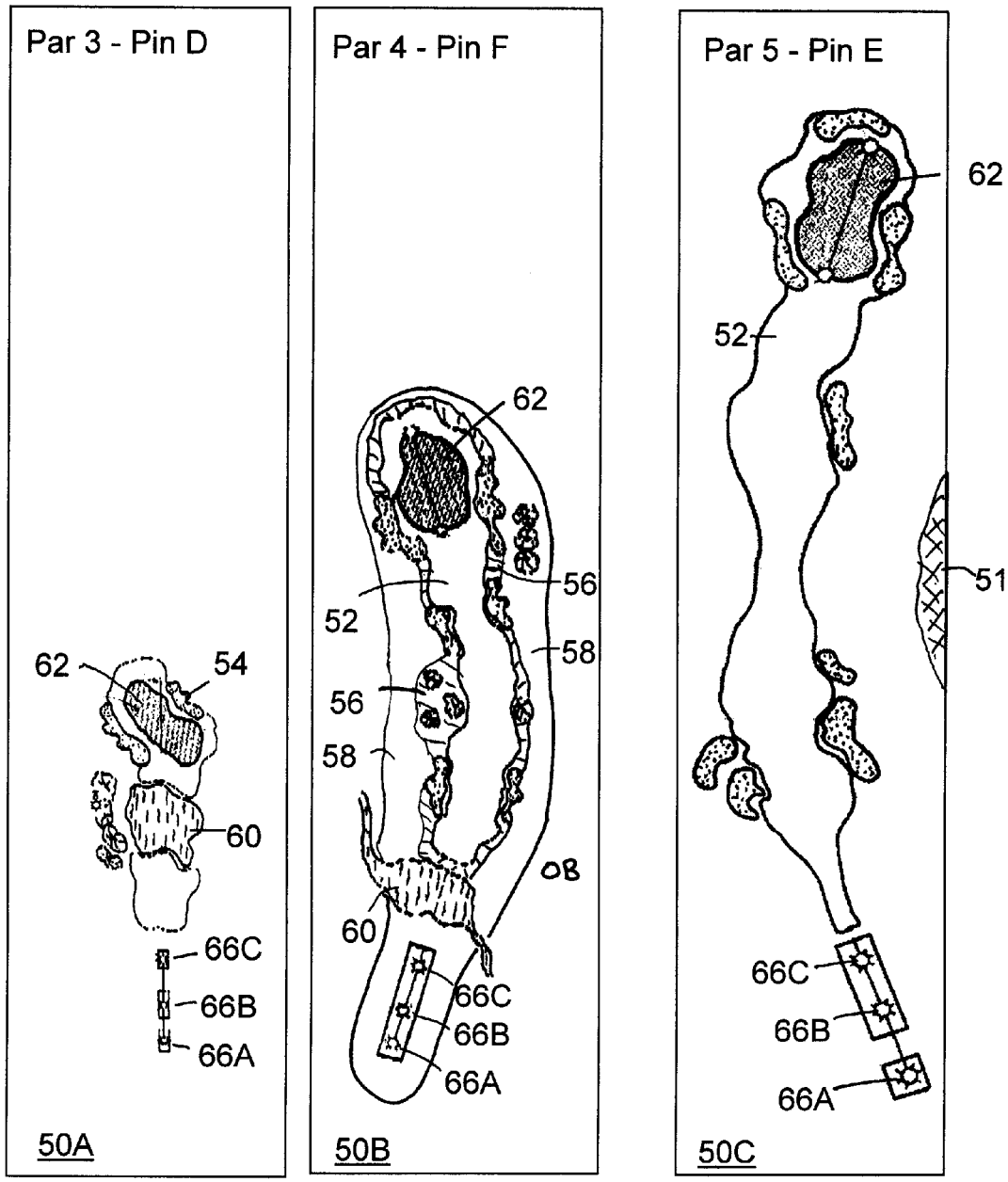
FIG. 3 is a view of three different cards.

The cards are scaled so that the yardage on the cover grid essentially agrees with the yardage on the cards. As such, the pictorial representation of a long par 5 hole, may cover essentially all of card 50, while the pictorial representation of a par 3 hole, may only cover a third of the card, or less. Variations of card 50 are shown in FIG. 3, and identified as cards 50*a*, 50*b*, and 50*c* representing a par 3 hole, a par 4 hole, and a par 5 hole, respectively.

On cards 50, features such as sand traps 54, short rough 56, long rough 58, and water 60 can all be seen, in addition to fairway 52. On each card, a green 62 is shown in addition to at least one tee. In the present embodiment, three tee 66*a*, 66*b*, and 66*c* are shown, and the player can decide what overall length of course is to be simulated in the game. Thus, one set of cards might be appropriate for the skill level of a variety of golfers. Alternatively, however, cards 50 may only be provided with one tee block that would be suitable for that particular player.

Out of bound areas 51 can been shown on the card, as seen in card 50*c*, or can be defined as being any shot that does not remain within the card grid. Alternatively, out of bounds might be any shot outside of the long rough 58, as shown as "OB" on card 50B. For an out of bounds shot, the player would penalize themselves according to the rules of golf. Preferably, the position of out of bounds can vary by the card set so that its position can be dependent on the player's skill and desired degree of difficulty.

Additionally, better players might be penalized with an out of bounds penalty for shots not staying on the card grid, while higher handicap players might consider these shots to merely end in the rough at an appropriate distance from the hole.

Further, a shot landing in water 60 or the like, would also be penalized according to the rules of golf, with the player playing his next shot from an appropriate position (e.g. behind the hazard entry point, in line with the pin, or the like).

Cover 12 is also scaled so as to preferably cover the entire card for the longest hole. As such, cover 12 should be capable of covering a hole having a length of at least 500 yards or more. Further, the width of cover 12 should also be capable of covering the width of the hole that is being played. As such, the cover width preferably represents a distance of 100 yards, and more preferably, a distance of 200 yards.

In a preferred embodiment, cover 12 (and also cards 50 and more generally handbook 10), have dimensions of between 3 by 7 inches, and 8 by 14 inches, and represent distances of between 100 by 450 yards and 200 by 600 yards, or any suitable values in between.

Cards 50 can also be modified so that the golfer can select the desired degree of difficulty. For example, a better player may use cards which include more hazards or bunkers, narrower fairways or the like, and thus would be more difficult to play. A less experienced player might opt for an easier course design. The difficulty of the cards might also be correlated to simulated course slope and course rating values in use to emulate actual golf courses. In this manner, a player might be able to select a simulated course having, for example, a rating of 71, and a slope of 125, which might match the course he would normally play.

The simulated golf game might be played by a single player in a single bay. However, a group of players may play the game from a single bay, with each player playing his or her shot in turn. Tournaments might also be played with a number of players at a number of different bays, and the handicaps of the players adjusted by providing course cards of different lengths and/or degrees of difficulty. The tournament might also be run over several hours or days with each player recording his or her own score while playing on their own.

A representation of a simple driving range 100 embodiment is shown in FIG. 4, and includes 4 "bays" 102 for use by the players, at one end of range 100. A grid 104 is provided on the surface of the range 100 with a more detailed grid 104*a* being provided nearer to the player. Targets 106 are provided for the players to use as their target points. Behind range 100 is a putting green 108 which is used by the player to putt out on each hole.

While not essential, range 100 is preferably slightly sloped so as to facilitate viewing of the golf ball, when it has landed.

In FIG. 5, an alternative driving range design 110 is shown having a series of greens 112 to which the play can aim at for shorter shots, or for shots to a par three. Greens 112 can be provided at different distances so that the player can select an appropriate green for shots of between, for example, 50 to 200 yards.

Figure 6:
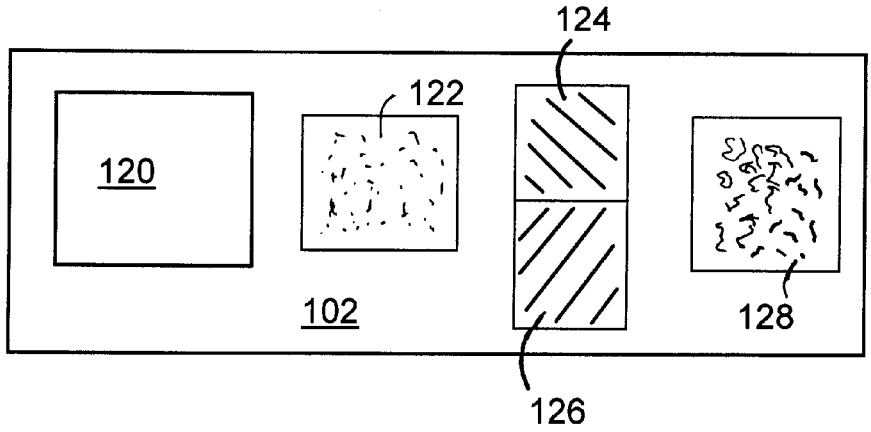
FIG. 6 is an overhead plan view of one embodiment of a driving range bay of use in the present invention.

Grid 104 has been replaced by a series of markers 114 that provide a target line, and a series of markers 116 which show distances off of the target line. With these markers, the player is able to establish both distance from bays 102, and distance from the target line. Further, markers 114 and 116 can be colour coded to show distances, such as, for example, red markers might represent 100 yards, white markers represent 150 yards, blue markers represent 200 yards, and the like In FIG. 6, details of a preferred embodiment of each of bays 102 is shown. In each bay, a grass tee area or mat 120, which acts as both the tee area, and the fairway, is shown in addition to the other specialized surfaces which might be encountered while playing the game. These surfaces can include, but are not limited to, sand 122, short rough 124, long rough 126 and pine chips 128. Other features that might be provided include sloped lies, or the like, or uphill or downhill shots in the case of a hole design that has an uphill or downhill component.

Each bay 102 can be fitted with at least one driving area, which can be a grass tee area, or a driving range mat, or the like, and specialized playing surfaces such as an area simulating rough, or areas simulating various lengths of rough, and/or any other playing surface which might be encountered on a typical golf course. Alternatively, though, these specialized surfaces might be provided in an area adjacent to one or more of the driving area bays.

Figure 7:
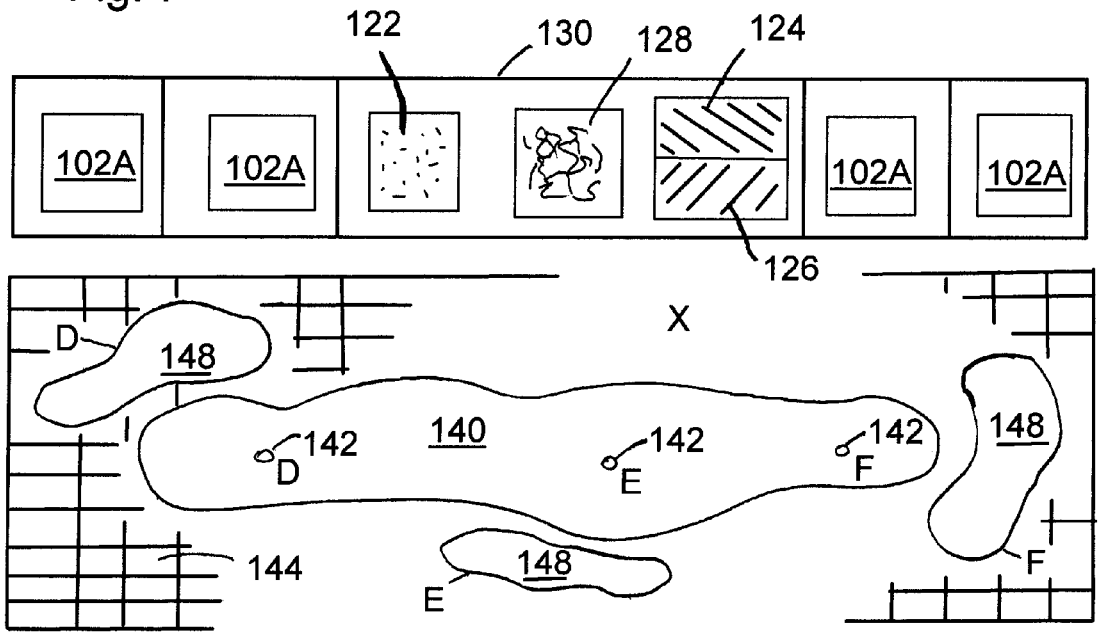
FIG. 7 is an overhead plan view of a second embodiment of the driving range bays, including an overview of a complete playing area environment.

As such, in FIG. 7, a series of 4 bays 102A are shown in which the specialized surfaces are all provided in a common area 130, and the users in bays 102A move to common area 130 as and when necessary.

Also, in FIG. 7, behind bays 102A, putting green 140 is shown having three "pins" 142 which can be designated as "D", "E", and "F". The representations of the greens on cards 50 can be modified so as to indicate the different pins 142 to be used for that hole, as seen in FIG. 3. Grid lines 144 (only partially shown) can be provided on and/or around putting green 140 to provide an indication for the player to determine his location on or near the green. Depending on the size of putting green 140, more or fewer pins can be provided, as desired.

As such, if a player determines that his shot to the green ended up 20 yards short and 10 yards left of the green having a pin placement "E", he would place his ball at a position in the vicinity of marker "X" on FIG. 7. It can also be seen how a player being 10 yards long and 5 right of pin "D" would be able to determine the appropriate spot for placement of his ball.

Also, the orientation of shots around green 140 can be varied so that a player who consistently misses a hole in one fashion (such as typically short left) would not always play from marker X, but might play from, for example, behind green 140 if the pin were designated as for example "a reverse E position".

Sand traps 148 are provided preferably near green 140 so as to provide greenside bunkers. These can be specifically related to the pin positions "D", "E" and "F", as previously disclosed.

Similarly, specific "chipping" areas (not shown) might also be defined around green 140, using the grid system, or using some other system such as a designated chipping area playable for each hole.

For the shots played on the driving range, the player would be expected to use the golf balls provided by the driving range. However, for chipping and putting, the player has the option of using his own golf balls, and thus can play these shots with his own particular type of ball. This enhances the simulation of an actual golf game.

A primary advantage of the present invention is that the player can select an appropriate strategy, and then move the grid markings on the cover in order to provide a suitable target. As such, for example, if a player decides that aiming down the left edge of a fairway is the appropriate strategy, he can establish his card in the handbook to provide the left edge as the target line. A player preferring the right edge could equally also select that edge as his target line. However, when both players hit, they would merely hit the ball towards the same target pole on the driving range, and then individually relate the outcome to their card. As such, a ball landing straight on line with the target pole would put one player on the left edge of the fairway, and the other player on the right edge of the fairway. As such, the player does not need to try to modify his target on the range to suit the targets provided on the playing card, as provided in some of the prior art. Instead, adjustment of the card beforehand, allows the player to quickly play all of his shots aimed straight towards the driving range target, or green (where available).

Thus, by moving the card under the cover grid, no offset of the driving range target is required, and the player merely hits each shot directly towards his target on the driving range.

It will be clear to the skilled artisan that the functions of the card, the handbook, and the cover can be simulated by a computerized system. For example, the computer screen might provide an overview of the hole being played, and a simulated grid that the golfer can overlay over the golf hole. Once the target is selected, the hole display would be removed until after the golfer had inputted the shot outcome using a mouse of some other pointing device, on the grid remaining on the screen. Variations on this arrangement might also be possible.

In one embodiment, a computer display could be provided at each bay, and the player can select the course and course difficulty through a menu system, and then play the game. The player could also record scores for each hole, keep track of clubs used, shot outcomes, in order to determine his playing statistics, and determine any weaknesses in his game. With these statistics, the game might be modified to require practice of any weak areas. For example, if long irons were found to be a weak area of a players game, but, for example, recording the degree of missed shots, than a course could be modified in order to provide more long irons shots and thus cause the player to play more of these shots, as a practice regimen.

In an additional embodiment, a computerized ball tracking system could be used in order to track the player's ball, and thus provide an automatic indication of the landing grid of the player's shot. This information might be automatically recorded on the card, or merely provided as information to the player.

Additionally, as with known driving ranges, the environment of the area used in the present application can be lit for use after dark. As such, this allows the player to play the game, or practice the game, when it would not be possible to play a normal round of golf. Further, the driving range bays and/or putting and chipping area might be covered so as to allow play to continue in spite of inclement weather or the like. Alternatively, the bays may be heated stalls to allow play in colder conditions.

Thus, it is apparent that there has been provided, in accordance with the present invention, a golf game, and golf practice facility which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

What is claimed is:

1. A method of playing a golf type game which simulates an actual golf game, which golf type game is played on at a golf practice facility comprising:

a driving range area which driving range area has at least one target, and is divided into a grid system for determining the outcome of a golf shot, and a driving range bay for a player to take said golf shot, a handbook comprising an essentially opaque cover having both a target reference indicator, and a grid system which correlates to the target and grid system found on the driving range area, and an indicator of the player's present position; and a plurality of cards providing pictorial representations of actual or virtual golf holes to be held within said handbook;

wherein said player plays the non-putting or chipping components of the game by:

reviewing a first card from said plurality of cards to determine a strategy for playing a shot on the golf hole represented and to be played on said card to determine a target for the player's shot;

inserting said card into said handbook so that said card is covered by said opaque cover, and moving said card so that said player's present position and target and/or target line are visible through said target reference indicator;

making a golf shot from said bay, which shot is targeted towards said target;

observing said shot to determine the outcome of said shot and determine the driving range grid coordinates of said outcome;

translating the driving range grid coordinates of said outcome to said handbook cover grid;

marking said card through said cover at the position of said handbook cover grid coordinates;

opening said cover to view said card;

reviewing said outcome on said card in order to determine a strategy for playing any additional shots on said hole; and repeating said method until the outcome of said player's shot is adjacent to, or on, a putting green or chipping area designated for said hole, on said card.

2. A method as claimed in claim 1 wherein said player target reference indicator is a slot or transparent area on the cover.

3. A method as claimed in claim 1 wherein said cover grid comprises a series of holes through the cover at preselected points on the grid system, which holes allow the golfer to mark or otherwise identify positions on said card.

4. A method as claimed in claim 1 wherein said driving range area additionally comprises simulated or actual target greens, which target greens are used to simulate approach shots to the green.

5. A method as claimed in claim 1 wherein 18 cards are provided to said player, and said cards are used one at a time in a pre-established order.

6. A method as claimed in claim 1 wherein each card is marked with yardage markers which correspond to driving range distance markers.

7. A method as claimed in claim 6 wherein said cards can by modified to provide additional hazards, bunkers, narrower fairways, or the like, so that the golfer can select the desired degree of difficulty for said game.

8. A method as claimed in claim 7 wherein said cards are modified to simulate a golf round on a golf course having pre-selected, simulated course slope and course rating values.

9. A method as claimed in claim 1 wherein said golf practice facility additionally comprises a putting green and/or a chipping area located adjacent to said driving range bay, and wherein said player moves to said putting green and/or chipping area to play the putting and/or chipping component of the game, when said shot outcome is indicated to be on or near said putting green or chipping area, and wherein said player places a golf ball on said putting green or chipping area surface, at or near a position established by said shot outcome, and then chips and/or putts until said golf hole is completed.

10. A method as claimed in claim 9 wherein said putting green and/or chipping area services at least two driving bays.

11. A method as claimed in claim 9 wherein said player plays the non-putting and chipping component of the game, followed by the putting and chipping component in series, so that said method provides a simulated golf hole.

12. A method as claimed in claim 9 wherein said putting green comprises two or more holes, and said putting green holes correspond to hole locations printed on said cards.

13. A method as claimed in claim 1 wherein said card or said cover provide distance indications which relate to the distance measurements of said driving range grid, so that said player determines both a desired target line and a desired distance.

14. A method as claimed in claim 1 wherein said driving range additionally includes an area having specialized surface areas selected from any or all of fairway, short rough, long rough, sand, or pine chips, and wherein said player hits his next shot from when specialized surface when said shot outcome is indicated on said card as being within one of the specialized surface areas.

15. A method as claimed in claim 14 wherein each driving range bay includes a variety of specialized surface areas.

16. A method of teaching the strategy of the game of golf comprising: having a player play the golf type game claimed in claim 1; providing a teaching professional to said player; and having the teaching professional review the strategy decisions made by the player during said golf type game.

* * * * *